US008047674B2

(12) United States Patent
Liu

(10) Patent No.: US 8,047,674 B2
(45) **Date of Patent: *Nov. 1, 2011**

(54) LED ILLUMINATING DEVICE

(75) Inventor: Tay-Jian Liu, Taipei Hsien (TW)

(73) Assignee: Foxconn Technology Co., Ltd., Tu-Cheng, New Taipei (TW)

( * ) Notice: Subject to any disclaimer, the term of this patent is extended or adjusted under 35 U.S.C. 154(b) by 216 days.

This patent is subject to a terminal disclaimer.

(21) Appl. No.: 12/486,726

(22) Filed: Jun. 17, 2009

(65) Prior Publication Data

US 2010/0142199 A1 Jun. 10, 2010

(30) Foreign Application Priority Data

Dec. 5, 2008 (CN) ..... 2008 1 0306000

(51) Int. Cl.
*F21V 29/00* (2006.01)
*F21S 4/00* (2006.01)

(52) U.S. Cl. ..... 362/218; 362/219; 362/223; 362/373

(58) Field of Classification Search ..... 362/221–223, 362/225, 240, 217.01, 218, 219, 294, 373, 362/249.02, 249.06, 249.14
See application file for complete search history.

(56) References Cited

U.S. PATENT DOCUMENTS

| | | | | |
|---|---|---|---|---|
| 6,078,136 | A * | 6/2000 | Sica | 313/493 |
| 6,472,823 | B2 * | 10/2002 | Yen | 315/112 |
| 6,612,717 | B2 * | 9/2003 | Yen | 362/245 |
| 7,387,403 | B2 * | 6/2008 | Mighetto | 362/218 |
| 7,611,260 | B1 * | 11/2009 | Lin et al. | 362/224 |
| 7,658,509 | B2 * | 2/2010 | Summers et al. | 362/249.11 |
| 2008/0158870 | A1 * | 7/2008 | Sun et al. | 362/218 |
| 2010/0008085 | A1 * | 1/2010 | Ivey et al. | 362/218 |

* cited by examiner

*Primary Examiner* — Thomas Sember
(74) *Attorney, Agent, or Firm* — Altis Law Group, Inc.

(57) ABSTRACT

An LED illuminating device includes a light-emitting module, a heat sink and an electrical module. The light-emitting module includes an elongated hollow light penetrable tube and a light source. The heat sink is received in and mounted to the light penetrable tube, and includes an elongated base and a plurality of fins. The light source is thermally attached to a bottom surface of the base. The base and an upper portion of the light penetrable tube cooperatively define a heat dissipation chamber. The fins are accommodated in the heat dissipation chamber. The light penetrable tube defines a plurality of air exchanging holes through the upper portion thereof communicating with the heat dissipation chamber. The electrical module includes at least one circuit board received in the heat dissipation chamber, and two end covers arranged at two ends of the light penetrable tube.

16 Claims, 7 Drawing Sheets

LED ILLUMINATING DEVICE

CROSS-REFERENCE TO RELATED APPLICATION

This application is related to a co-pending U.S. patent application entitled "LED ILLUMINATION DEVICE" (Ser. No. 12/486,722) and filed in the same day as the instant application. The co-pending U.S. patent application is assigned to the same assignee as the instant application. The disclosure of the above-identified application is incorporated herein by reference.

BACKGROUND

1. Technical Field

The present disclosure relates to light emitting diode (LED) illuminating devices, and particularly to an LED illuminating device with high heat dissipating efficiency.

2. Description of Related Art

In recent years, LEDs are preferred for use in illuminating devices rather than CCFLs (cold cathode fluorescent lamps) and other traditional lamps due to LEDs excellent properties, including high brightness, long lifespan, wide color range, and etc.

For an LED, about eighty percents of the power consumed thereby is converted into heat. Generally, an LED illuminating device includes a plurality of LEDs arranged on a substrate to obtain a desired brightness and illumination area. However, the plurality of LEDs generate a large amount of heat during operation which endangers the normal operation of the LEDs of the LED illuminating device. A highly efficient heat dissipation device is necessary in order to timely and adequately remove the heat generated by the LED illuminating device. Otherwise, the brightness, lifespan, and reliability of the LED illuminating device will be seriously affected.

For the foregoing reasons, therefore, there is a need in the art for an LED illuminating device which overcomes the limitations described.

BRIEF DESCRIPTION OF THE DRAWINGS

Many aspects of the present embodiments can be better understood with reference to the following drawings. The components in the drawings are not necessarily drawn to scale, the emphasis instead being placed upon clearly illustrating the principles of the present embodiments. Moreover, in the drawings, like reference numerals designate corresponding parts throughout the several views.

DETAILED DESCRIPTION

Figure 1:
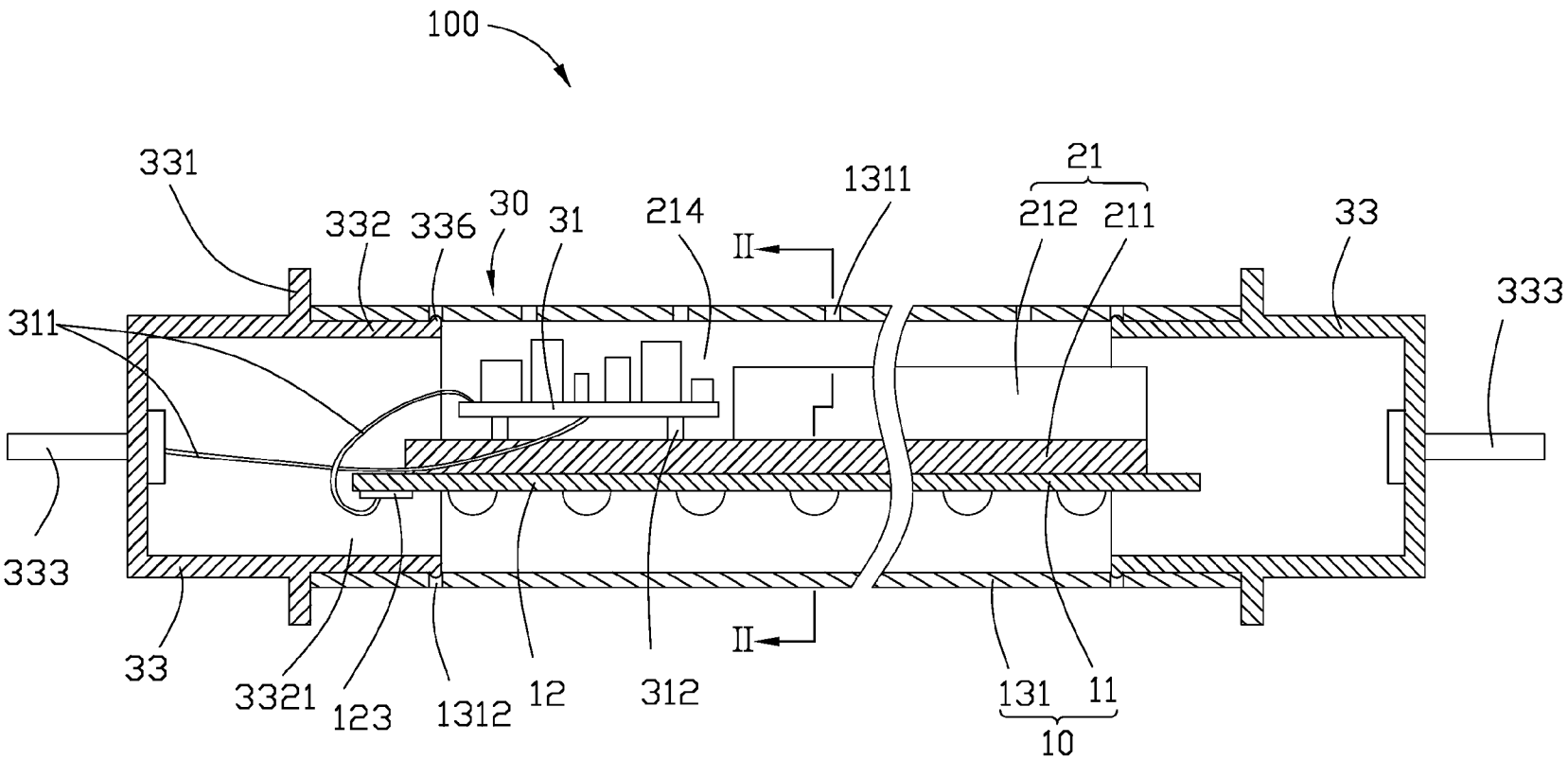
FIG. 1 is a longitudinal cross-sectional view of an LED illuminating device in accordance with a first embodiment.
Figure 2:
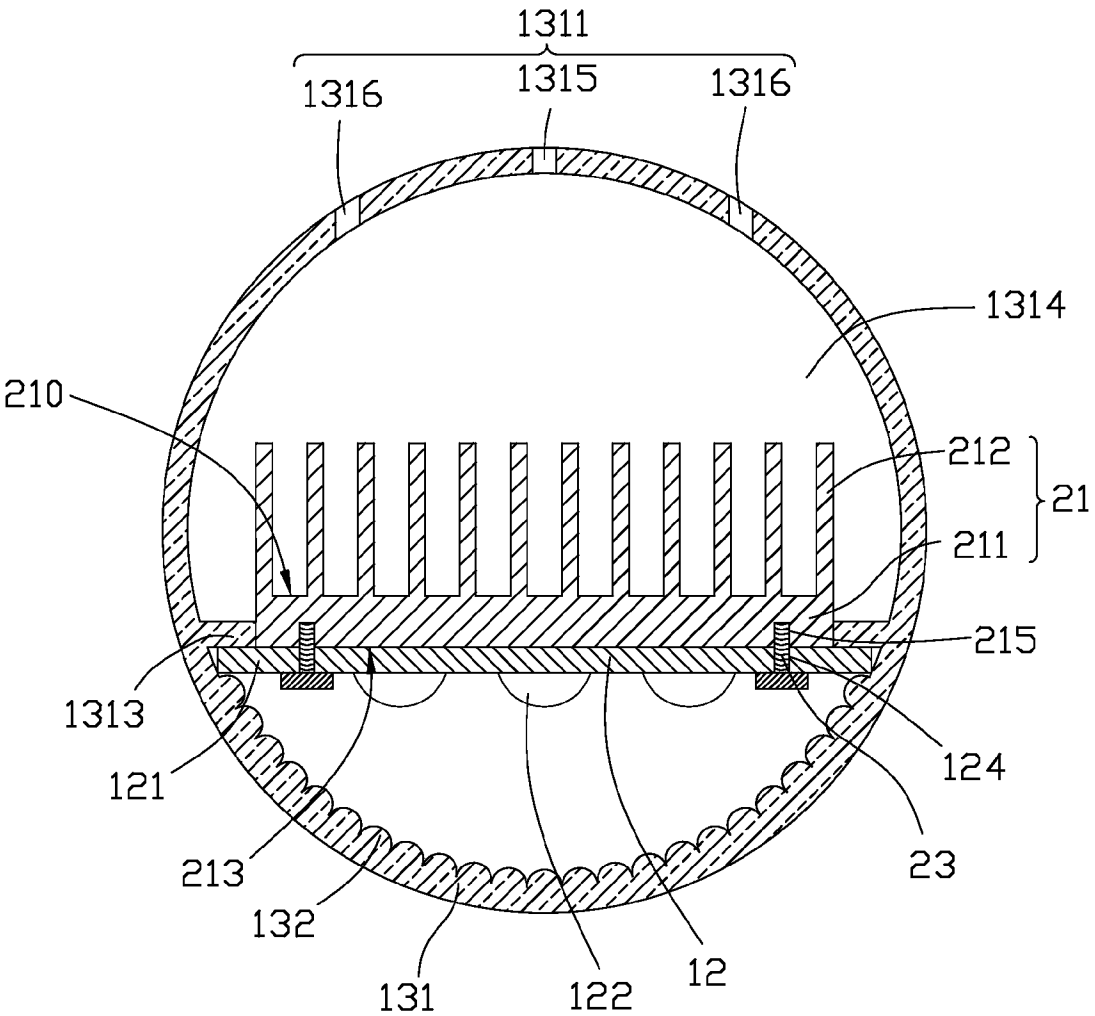
FIG. 2 is an enlarged, transverse cross-sectional view of the LED illuminating device of FIG. 1, taken along line II-II thereof.

Referring to FIGS. 1 and 2, an LED illuminating device 100 according to an exemplary embodiment includes a heat sink 21, a light-emitting module 10, and an electrical module 30 electrically connected with the light-emitting module 10.

The heat sink 21 includes an elongated metal base 211 and a plurality of spaced metal fins 212 integrally extending from the base 211. The base 211 is substantially rectangular, and has a top surface 210 and an opposite bottom surface 213. The fins 212 extend vertically and upwardly from the top surface 210 of the base 211 and have a uniform height.

The heat sink 21 is provided with a receiving space 214 at a top side thereof. The receiving space 214 is located adjacent to a left end of the heat sink 21, and formed by cutting out the fins 212 and a portion of the base 211 of the left end of the heat sink 21. Alternatively, the receiving space 214 can be provided at other positions of the top side of the heat sink 21, such as at a center position of the top side of the heat sink 21. Still alternatively, the receiving space 214 can be integrally formed during the formation of the heat sink 21 by aluminum extrusion, wherein the fins 212 are formed to have an original length the same as that shown in FIG. 1 so that the cutting of the fins 212 for forming the receiving space 214 can be omitted. The base 211 defines a plurality of fixing holes 215 in the bottom surface 213 thereof.

The light-emitting module 10 includes a light source 11 provided with a plurality of LEDs 122, and an elongated light penetrable tube 131. The light source 11 is thermally attached to the bottom surface 213 of the base 211 of the heat sink 21. The bottom surface 213 of the base 211 functions as a heat-absorbing surface for the light source 11, and the top surface 210 of the base 211 functions as a heat-spreading surface for the light source 11.

Figure 3:
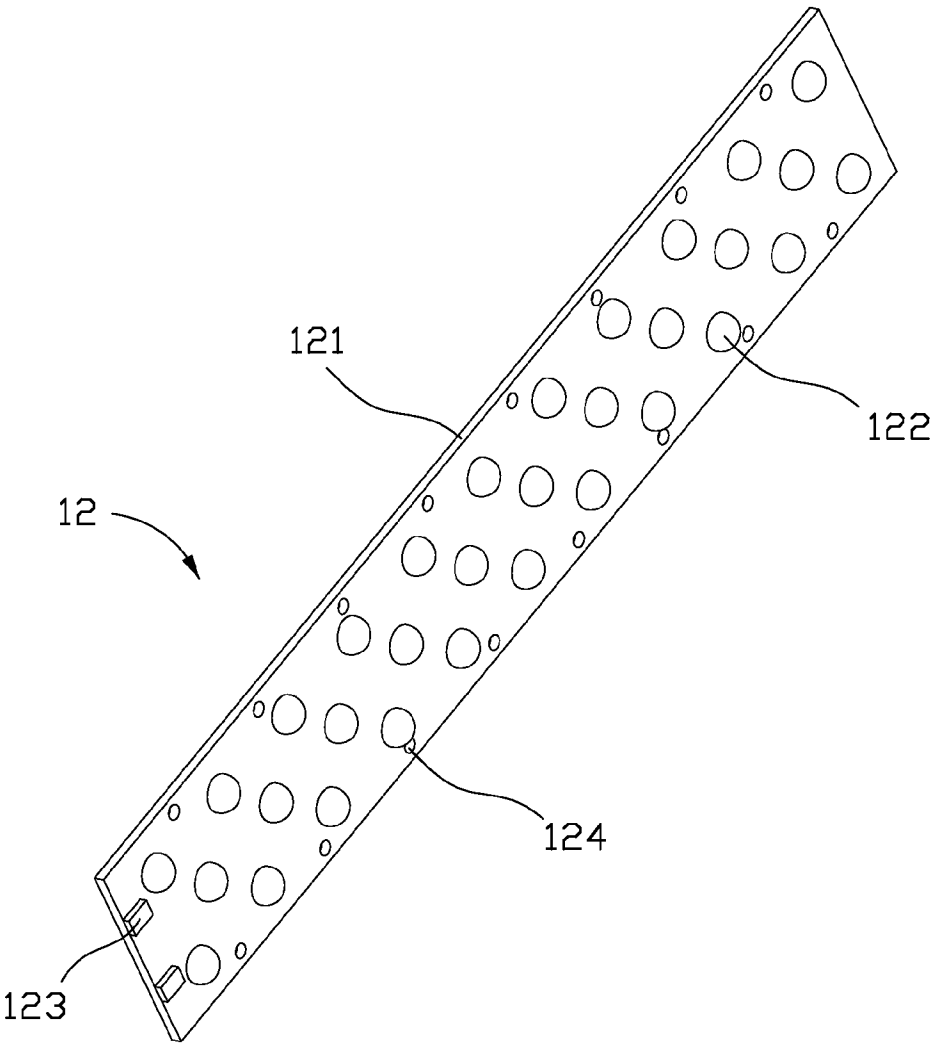
FIG. 3 is an isometric view of a light bar of the LED illuminating device of FIG. 1.

The light source 11 includes a light bar 12. Referring to FIG. 3, the light bar 12 includes an elongated substrate 121 forming electrical circuits thereon, and a pair of electrodes 123 formed at an end of the substrate 121. The plurality of LEDs 122 are arranged on the substrate 121 and evenly spaced from each other along the substrate 121. The LEDs 122 and the electrodes 123 are electrically connected to the electrical circuits formed on the substrate 121. A plurality of through holes 124 are defined near two opposite lateral sides of the substrate 121 corresponding to the fixing holes 215 of the base 211. Fixing devices 23, such as screws, extend through the through holes 124 of the substrate 121 of the light bar 12 and threadedly engage into the fixing holes 215 of the base 211, thereby to securely and thermally attach the light bar 12 to the bottom surface 213 of the base 211. A longitudinal length and a transverse width of the substrate 121 are greater than those of the base 211, respectively, whereby two opposite ends and two lateral sides of the substrate 121 extend horizontally and outwardly beyond the base 211.

When the light bar 12 is mounted to the bottom surface 213 of the base 211, a layer of thermal interface material (TIM) may be applied between the substrate 121 and the bottom surface 213 to eliminate an air interstice therebetween, to thereby enhance a heat conduction efficiency between the light bar 12 and the base 211. Alternatively, the substrate 121 of the light bar 12 can be attached to the bottom surface 213 of the base 211 fixedly and intimately through surface mount technology (SMT). Still alternatively, the substrate 121 can be omitted and the circuits of the substrate 121 are integrally formed on the heat sink 21, whereby an interface between the substrate 121 and the base 211 of the heat sink 21 can be eliminated and a thermal resistance between the LEDs 122 and the base 211 is reduced.

The light penetrable tube 131 is a hollow cylinder. The heat sink 21 and the light bar 12 of the light source 11 are received in the light penetrable tube 131. Two opposite supporting members 1313 are formed on an inner surface of the light penetrable tube 131 and extend along an axial direction of the light penetrable tube 131. The two opposite supporting members 1313 are located at a lower portion of the light penetrable tube 131 and spaced from each other. Two lateral sides of the substrate 121 of the light bar 12 are located under the two supporting members 1313, respectively. Each lateral side of the substrate 121 is sandwiched between a bottom surface of a corresponding supporting member 1313 and the inner surface of the light penetrable tube 131. The base 211 of the heat sink 21 is sandwiched between the two supporting members 1313, with two lateral sides of the base 211 contacting with the two supporting members 1313, respectively. The heat sink 21 and an upper portion of the light penetrable tube 131 cooperatively define a heat dissipation chamber 1314 therebetween. The fins 212 of heat sink 21 are accommodated in the heat dissipation chamber 1314.

The light penetrable tube 131 defines a plurality of air exchanging holes 1311 through the upper portion thereof and located above the heat sink 21. The air exchanging holes 1311 communicate the outer environment with the heat dissipation chamber 1314. The air exchanging holes 1311 include a plurality of first through holes 1315 located at a topmost portion of the light penetrable tube 131 and evenly spaced from each other along the axial direction of the light penetrable tube 131, and a plurality of second through holes 1316 located at two lateral sides of the first through holes 1315. The second through holes 1316 are lower than the first through holes 1315 and evenly spaced from each other along the axial direction of the light penetrable tube 131.

A plurality of light guiding protrusions 132 are formed on the inner surface of the lower portion of the light penetrable tube 131 under the light bar 12 of the light source 11 and extend along the axial direction of the light penetrable tube 131. The light guiding protrusions 132 are arranged closely to each other along a circumferential direction of the light penetrable tube 131. Light emitted by the LEDs 122 of the light source 11 is evenly diffused to the outer environment by the light guiding protrusions 132 of the light penetrable tube 131, to thereby expand the illumination area of the LED illuminating device 100 and reduce glare from the LED illuminating device 100.

Figure 4:
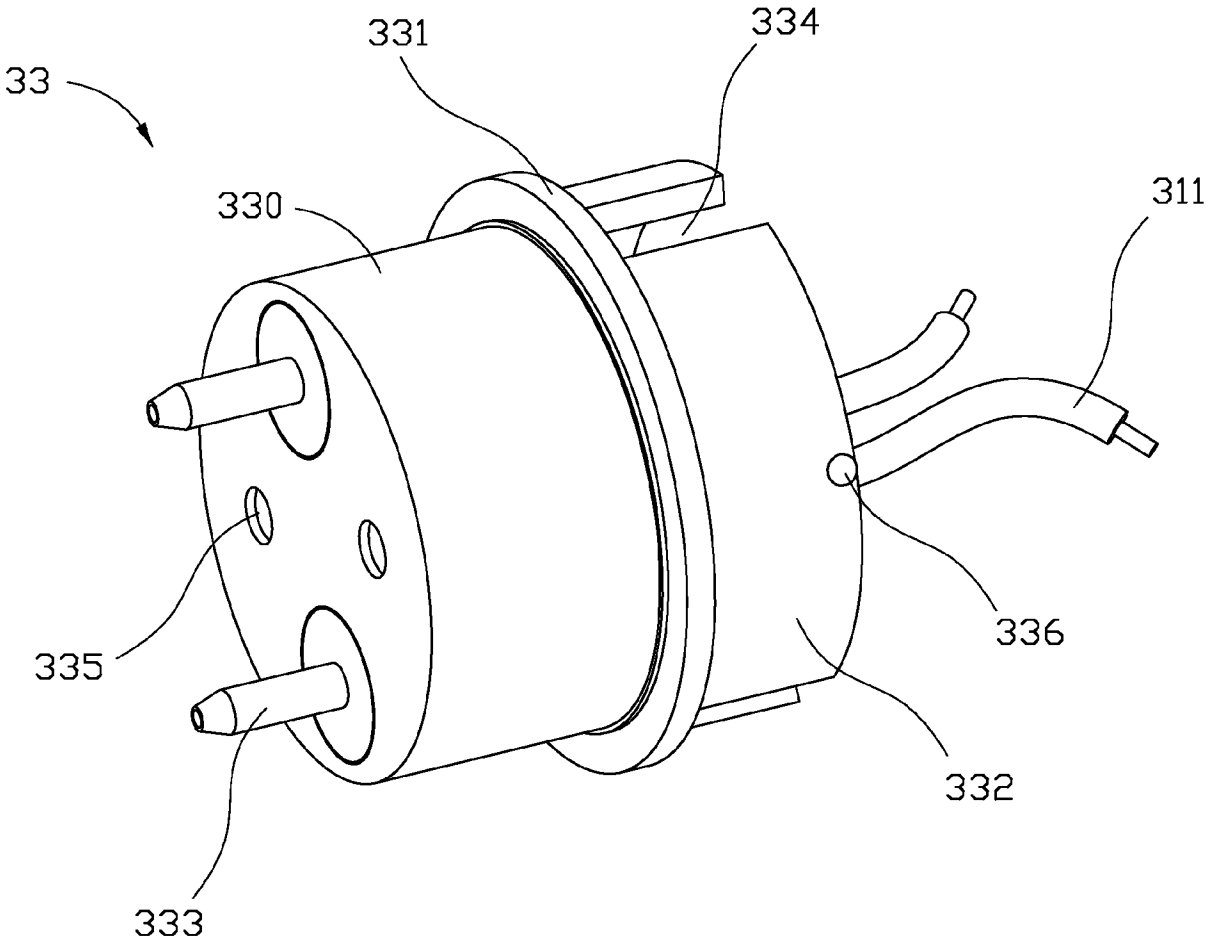
FIG. 4 is an isometric view of an end cover of the LED illuminating device of FIG. 1.

The electrical module 30, which provides drive power, control circuit and power management for the light source 11, includes a circuit board 31, two end covers 33 (i.e., left end cover and right end cover), and two pairs of pins 333. The two end covers 33 are arranged at two opposite ends of the light penetrable tube 131. Each end cover 33 is connected with one pair of the pins 333. Referring to FIG. 4, the end cover 33 is substantially a hollow cylinder. The end cover 33 includes a mounting section 330 at an outer side thereof, a connecting section 332 at an inner side thereof, and a projecting ring 331 between the mounting section 330 and the connecting section 332. The connecting section 332 defines a receiving room 3321 (FIG. 1) therein communicating with the heat dissipation chamber 1314, and a pair of elongated positioning grooves 334 through inner and outer surfaces thereof. The positioning grooves 334 are arranged symmetrically to a center axis of the end cover 33, and extend from an inner end of the connecting section 332 to the projecting ring 331 along an axial direction of the end cover 33. A pair of diametrically opposite projecting beads 336 are formed on the outer surface of the connecting section 332 and evenly spaced from each other along a circumferential direction of the connecting section 332. Each projecting bead 336 is located amid the positioning grooves 334. The light penetrable tube 131 defines a pair of diametrically opposite engaging holes 336 (FIG. 1) at each of two opposite ends thereof corresponding to the projecting beads 336 of each of the two end covers 33, to thereby mount the two end covers 33 to the two opposite ends of the light penetrable tube 131. The projecting ring 331 extends radially and outwardly from an outer circumferential surface of the end cover 33, and has an outer diameter larger than those of the mounting section 330 and the connecting section 332. The pair of the pins 333 is column-shaped and connected to an outer end surface of the mounting section 330. The pair of the pins 333 and the mounting section 330 can be used for engaging with a traditional fluorescent lamp holder to mount the LED illuminating device 100 thereon. Two air venting holes 335 are axially defined through the outer end surface of the mounting section 330 and communicate with the receiving room 3321 of the connecting section 332.

The circuit board 31 is accommodated in the receiving space 214 of the heat sink 21 and fixed to the base 211 of the heat sink 21 via a plurality of mounting poles 312.

In assembly of the LED illuminating device 100, the circuit board 31 is accommodated in the receiving space 214 of the heat sink 21. The light bar 12 of the light source 11 is securely and thermally attached to the bottom surface 213 of the base 211, with a peripheral edge of the light bar 12 extending outwardly beyond a peripheral edge of the heat sink 21. The heat sink 21 and the light source 11 are cooperatively inserted in and mounted to the light penetrable tube 113. The circuit board 31 is electrically connected to the electrodes 123 of the light bar 12 and inner ends of the pins 333 of the left end cover 33 via a plurality of wires 311. The connecting section 332 of the left end cover 33 is inserted inwardly into a left end of the light penetrable tube 131 till the projecting ring 331 abutting the left end of the light penetrable tube 131. At the same time, two opposite lateral sides of a left end of the substrate 121 are inserted in the positioning grooves 334 of the left end cover 33, and the projecting beads 336 of the connecting section 332 of the left end cover 33 are received in the engaging holes 336 of the left end of the light penetrable tube 131. The right end cover 33 is mounted to a right end of the light penetrable tube 131 in a manner similar to that of the left end cover 33 mounted to the left end of the light penetrable tube 131.

During operation, the circuit board 31 is electrically connected to the light source 11 and the pairs of the pins 333 of the left end cover 33, whereby an external power source can supply electric current to the LEDs 122 through the pairs of the pins 333 and the circuit board 31 to cause the LEDs 122 to emit light. The light of the LEDs 122 travels through the lower portion of the light penetrable tube 131 to an outside for lighting.

A large amount of heat is generated by the LEDs 122 during the operation of the LED illuminating device 100. As the light bar 12 of the light source 11 is thermally attached to the heat sink 21, the heat generated by the LEDs 122 can be conducted to the heat sink 21 for dissipation. Air in the heat dissipation chamber 1314 is heated by heat transferred to the base 211 and the fins 212 of the heat sink 21, and then flows upwardly. The heated, upwardly flowing air escapes to ambient atmosphere particularly via the first through holes 1315 of the air exchanging holes 1311. Cooling air in the ambient atmosphere enters into the heat dissipation chamber 1314 particularly via the second through holes 1316 of the air exchanging holes 1311 and via air venting holes 335 of the two end covers 33, whereby a natural air convection is circulated through the heat dissipation chamber 1314 for continuously dissipating the heat generated by the LEDs 122 and the circuit board 31. Thus, the LEDs 122 can be kept working at a lower temperature, and the brightness, lifespan, and reliability of the LED illuminating device 100 will be improved.

Figure 5:
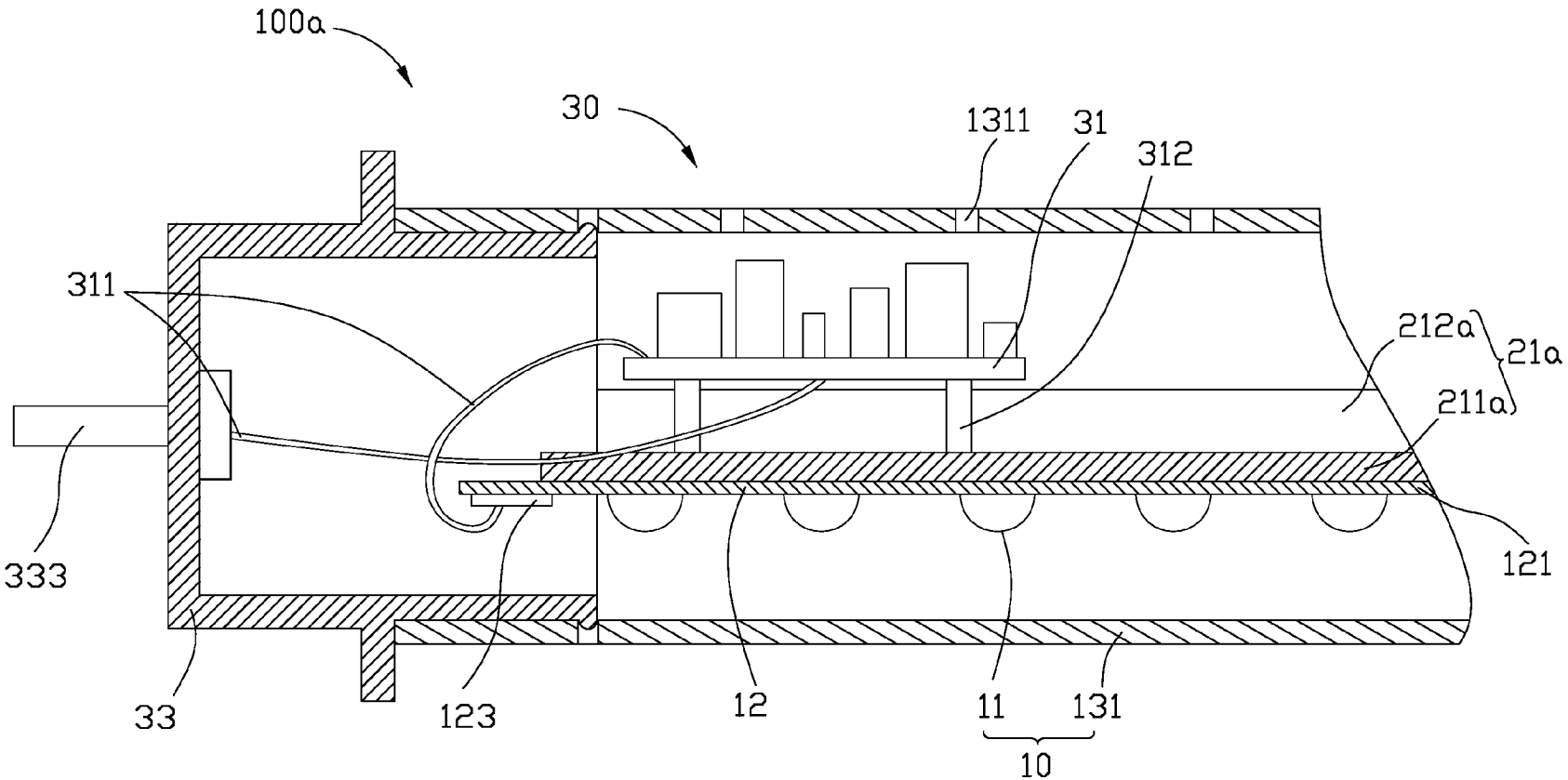
FIG. 5 is a longitudinal cross-sectional view of a part of an LED illuminating device in accordance with a second embodiment.

Referring to FIG. 5, an LED illuminating device 100*a* according to a second embodiment is illustrated. Except the following differences, the LED illuminating device 100*a* of the present embodiment is essentially the same as LED illuminating device 100 of the previous embodiment. In the present embodiment, a heat sink 21*a* of the LED illuminating device 100*a* has a smaller size than the heat sink 21 shown in FIGS. 1-2, and no receiving space 214 is provided at a top side of the heat sink 21*a*. The heat sink 21*a* includes a base 211*a* and a plurality of fins 212*a* formed on the base 211*a*. The circuit board 31 is located between top ends of the fins 212*a* and an upper portion of the light penetrable tube 131 and mounted to the base 211*a* via a plurality of mounting poles 312.

Figure 6:
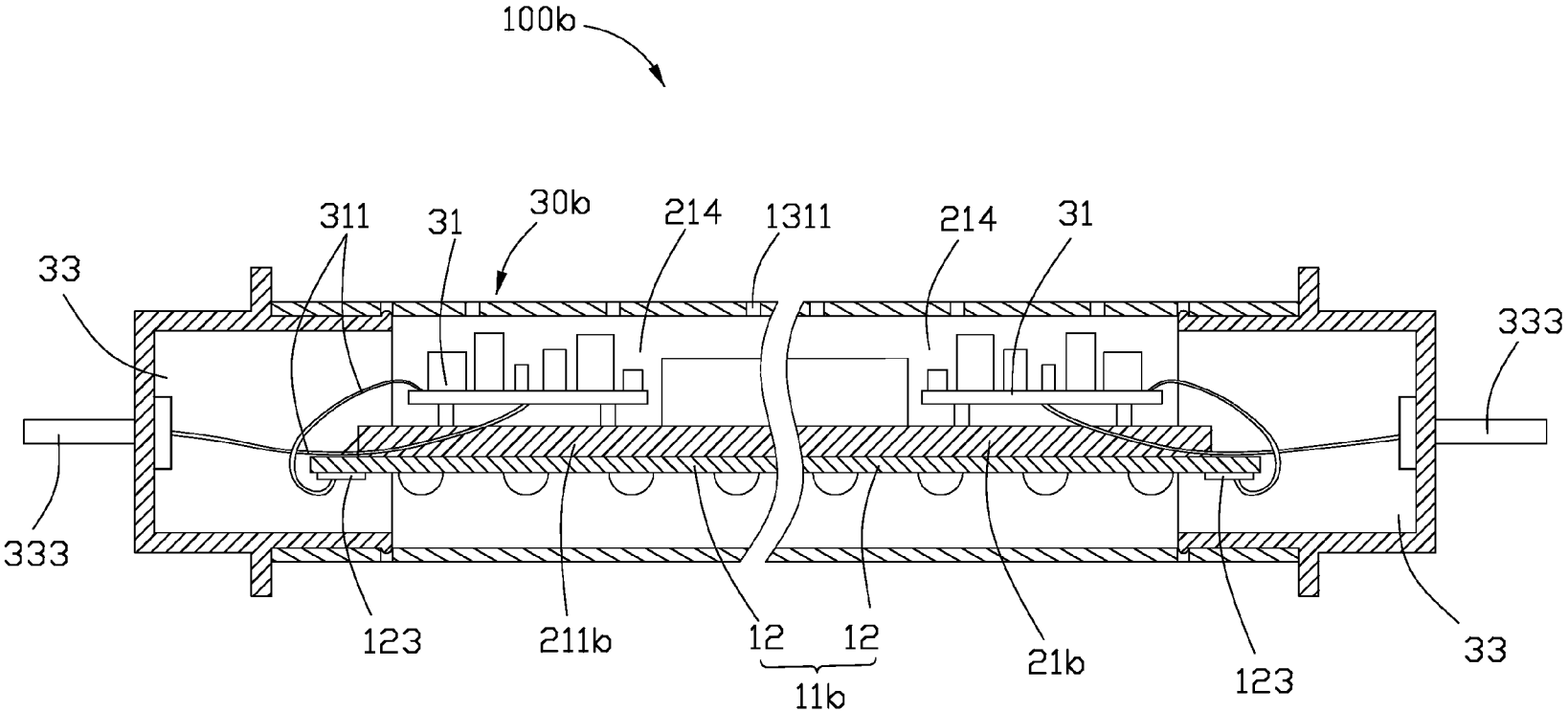
FIG. 6 is a longitudinal cross-sectional view of an LED illuminating device in accordance with a third embodiment.

Referring to FIG. 6, an LED illuminating device 100*b* according to a third embodiment is illustrated. The LED illuminating device 100*b* includes a light source 11*b*, a heat sink 21*b* arranged above the light source 11*b*, and an electrical module 30*b* electrically connected with the light source 11*b*. Except the following differences, the LED illuminating device 100*b* of the present embodiment is essentially the same as LED illuminating device 100 of the previous embodiment. In the present embodiment, the light source 11*b* includes two light bars 12 as shown in FIG. 3. The light bars 12 are arranged along the base 211*b* of the heat sink 21*b*. A length of the heat sink 21*b* is greater (approximately twice) than that of the heat sink 21 of the LED illuminating device 100. The heat sink 21*b* defines two receiving spaces 214 at two opposite ends thereof. The electrical module 30*b* includes two circuit boards 31 respectively accommodated in the two receiving spaces 214 of the heat sink 21*b*. The two circuit boards 31 are electrically connected to the two light bars 12, respectively. Each circuit board 31 is electrically connected to the electrodes 123 of a corresponding light bar 12 and the pins 333 of a corresponding end cover 33 via wires 311. Comparing with the LED illuminating device 100, the illumination area and illumination capability of the LED illuminating device 100*a* are greatly increased.

Figure 7:
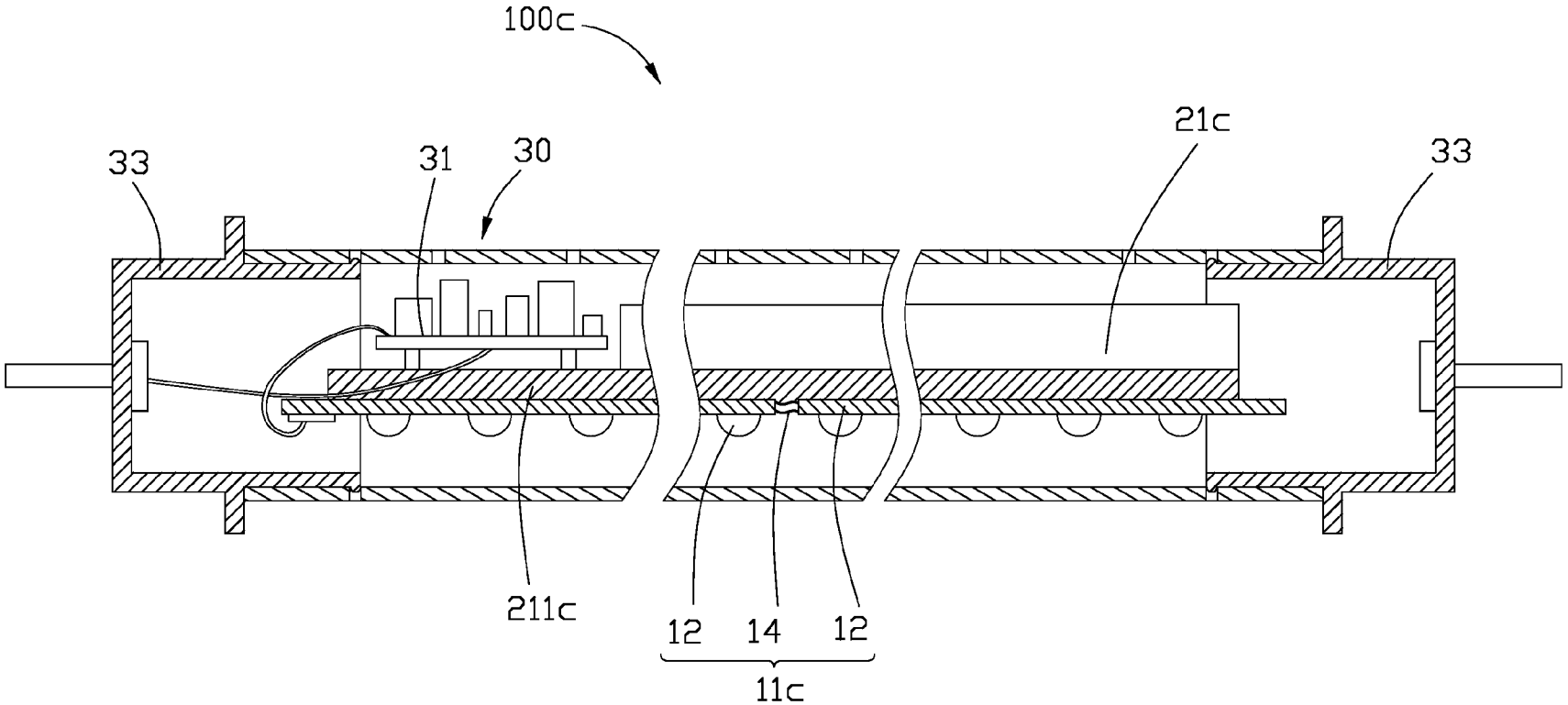
FIG. 7 is a longitudinal cross-sectional view of an LED illuminating device in accordance with a forth embodiment.

Referring to FIG. 7, an LED illuminating device 100*c* according to a fourth embodiment is illustrated. Except the following differences, the LED illuminating device 100*c* of the present embodiment is essentially the same as LED illuminating device 100 of the previous embodiment. In the present embodiment, a light source 11*c* of the LED illuminating device 100*c* includes at least two light bars 12 as shown in FIG. 3. The light bars 12 are arranged along a base 211*c* of the heat sink 21*c*. Two adjacent light bars 12 are electrically connected with each other via a plurality of connecting wires 14. Accordingly, the heat sink 21*c* is several times longer than the heat sink 21 of the LED illuminating device 100, to thereby mount the light bars 12 thereon. Thus, the illumination area and illumination capability of the LED illuminating device 100*c* are greatly increased.

It is to be understood, however, that even though numerous characteristics and advantages of the disclosure have been set forth in the foregoing description, together with details of the structure and function of the disclosure, the disclosure is illustrative only, and changes may be made in detail, especially in matters of shape, size, and arrangement of parts within the principles of the disclosure to the full extent indicated by the broad general meaning of the terms in which the appended claims are expressed.

What is claimed is:

1. An LED illuminating device, comprising:

a light-emitting module comprising an elongated hollow light penetrable tube and a light source received in the light penetrable tube, the light source being provided with a plurality of LEDs; a heat sink received in and mounted to the light penetrable tube, the heat sink comprising an elongated base and a plurality of fins extending from the base, the base having a top surface and an opposite bottom surface, the fins extending upwardly from the top surface of the base, the light source being thermally attached to the bottom surface of the base, the base defining a plurality of fixing holes in the bottom surface thereof, the light source facing a bottom portion of the light penetrable tube and light emitted by the light source being guided to an outer environment through the bottom portion of the light penetrable tube, the base of the heat sink and an upper portion of the light penetrable tube cooperatively defining a heat dissipation chamber therebetween, the fins of the heat sink being accommodated in the heat dissipation chamber, the light penetrable tube defining a plurality of air exchanging holes through the upper portion thereof, the air exchanging holes communicating the outer environment with the heat dissipation chamber for air flowing into and out of the heat dissipation chamber; and an electrical module comprising at least one circuit board and two end covers, the at least one circuit board being received in the heat dissipation chamber and electrically connected to the light source, the two end covers being arranged at two opposite ends of the light penetrable tube;

wherein the light source further comprises at least one elongated substrate attached to the bottom surface of the base, a plurality of electrodes formed on the at least one substrate, the plurality of LEDs being arranged on the at least one substrate and evenly spaced from each other along the at least one substrate;

wherein a longitudinal length and a transverse width of the substrate are greater than those of the base;

wherein a plurality of through holes are defined near two opposite lateral sides of the substrate corresponding to the fixing holes of the base; and wherein at least one air venting hole is axially defined in each of the two end covers and communicates with the heat dissipation chamber.

2. The LED illuminating device of claim 1, wherein the heat sink is provided with at least one receiving space at a top side thereof, and the at least one circuit board is accommodated in the at least one receiving space.

3. The LED illuminating device of claim 2, wherein the at least one receiving space is formed by cutting out a portion of the heat sink at the top side thereof.

4. The LED illuminating device of claim 2, wherein the at least one receiving space is provided adjacent to one end of the heat sink.

5. The LED illuminating device of claim 1, wherein each of the two end covers comprises a mounting section at an outer side thereof, a connecting section at an inner side thereof, and a projecting ring between the mounting section and the connecting section, the connecting section defining a receiving room therein communicating with the heat dissipation chamber and a pair of elongated positioning grooves through inner and outer surfaces thereof, the connecting section of each of the two end covers being inserted in a corresponding end of the light penetrable tube, two opposite ends of the at least one substrate respectively extending outwardly beyond two opposite ends of the heat sink and being respectively inserted in the positioning grooves of the two end covers.

6. The LED illuminating device of claim 5, wherein a plurality of air venting holes are axially defined in an outer end surface of the mounting section of each of the two end covers and communicate with the receiving room of the connecting section.

7. The LED illuminating device of claim 5, wherein each of the two end covers forms at least one projecting bead on the outer surface of the connecting section thereof, the light penetrable tube defines at least one engaging hole at each of the two opposite ends thereof for receiving the at least one projecting bead therein.

8. The LED illuminating device of claim 1, wherein two opposite supporting members are formed on an inner surface of the light penetrable tube and extend along an axial direction of the light penetrable tube, the two opposite supporting members being spaced from each other, each of two lateral sides of the substrate being sandwiched between a corresponding supporting member and the inner surface of the light penetrable tube, the base of the heat sink being sandwiched between the two supporting members.

9. The LED illuminating device of claim 1, wherein a plurality of light guiding protrusions are formed on an inner surface of the lower portion of the light penetrable tube under the light source and extend along an axial direction of the light penetrable tube.

10. The LED illuminating device of claim 1, wherein the electrical module further comprises two pairs of pins located at two opposite ends of the LED illuminating device, each of the two end covers being connected with one pair of the pins, the at least one circuit board is electrically connected to one pair of the pins.

11. The LED illuminating device of claim 1, wherein the at least one circuit board is located between top ends of the fins and the upper portion of the light penetrable tube.

12. The LED illuminating device of claim 1, wherein the air exchanging holes comprise a plurality of first through holes located at a topmost portion of the light penetrable tube and evenly spaced from each other along an axial direction of the light penetrable tube, and a plurality of second through holes located at two lateral sides of the first through holes, the second through holes being lower than the first through holes and evenly spaced from each other along the axial direction of the light penetrable tube.

13. An LED illuminating device, comprising:

a light-emitting module comprising an elongated hollow light penetrable tube and a light source received in the light penetrable tube, the light source being provided with a plurality of LEDs;

a heat sink received in and mounted to the light penetrable tube, the heat sink comprising an elongated base and a plurality of fins extending from the base, the base having a top surface and an opposite bottom surface, the fins extending upwardly from the top surface of the base, the light source being thermally attached to the bottom surface of the base, the light source facing a bottom portion of the light penetrable tube and light emitted by the light source being guided to an outer environment through the bottom portion of the light penetrable tube, the base of the heat sink and an upper portion of the light penetrable tube cooperatively defining a heat dissipation chamber therebetween, the fins of the heat sink being accommodated in the heat dissipation chamber, the light penetrable tube defining a plurality of air exchanging holes through the upper portion thereof, the air exchanging holes communicating the outer environment with the heat dissipation chamber for air flowing into and out of the heat dissipation chamber; and an electrical module comprising at least one circuit board and two end covers, the at least one circuit board being received in the heat dissipation chamber and electrically connected to the light source, the two end covers being arranged at two opposite ends of the light penetrable tube;

wherein the light source further comprises at least one elongated substrate attached to the bottom surface of the base, a plurality of electrodes formed on the at least one substrate, the plurality of LEDs being arranged on the at least one substrate and evenly spaced from each other along the at least one substrate; and wherein each of the two end covers comprises a mounting section at an outer side thereof, a connecting section at an inner side thereof, and a projecting ring between the mounting section and the connecting section, the connecting section defining a receiving room therein communicating with the heat dissipation chamber and a pair of elongated positioning grooves through inner and outer surfaces thereof, the connecting section of each of the two end covers being inserted in a corresponding end of the light penetrable tube, two opposite ends of the at least one substrate respectively extending outwardly beyond two opposite ends of the heat sink and being respectively inserted in the positioning grooves of the two end covers.

14. The LED illuminating device of claim 13, wherein a plurality of air venting holes are axially defined in an outer end surface of the mounting section of each of the two end covers and communicate with the receiving room of the connecting section.

15. The LED illuminating device of claim 13, wherein each of the two end covers forms at least one projecting bead on the outer surface of the connecting section thereof, the light penetrable tube defines at least one engaging hole at each of the two opposite ends thereof for receiving the at least one projecting bead therein.

16. An LED illuminating device, comprising:

a light-emitting module comprising an elongated hollow light penetrable tube and a light source received in the light penetrable tube, the light source being provided with a plurality of LEDs;

a heat sink received in and mounted to the light penetrable tube, the heat sink comprising an elongated base and a plurality of fins extending from the base, the base having a top surface and an opposite bottom surface, the fins extending upwardly from the top surface of the base, the light source being thermally attached to the bottom surface of the base, the light source facing a bottom portion of the light penetrable tube and light emitted by the light source being guided to an outer environment through the bottom portion of the light penetrable tube, the base of the heat sink and an upper portion of the light penetrable tube cooperatively defining a heat dissipation chamber therebetween, the fins of the heat sink being accommodated in the heat dissipation chamber, the light penetrable tube defining a plurality of air exchanging holes through the upper portion thereof, the air exchanging holes communicating the outer environment with the heat dissipation chamber for air flowing into and out of the heat dissipation chamber; and an electrical module comprising at least one circuit board and two end covers, the at least one circuit board being received in the heat dissipation chamber and electrically connected to the light source, the two end covers being arranged at two opposite ends of the light penetrable tube;

wherein the light source further comprises at least one elongated substrate attached to the bottom surface of the base, a plurality of electrodes formed on the at least one substrate, the plurality of LEDs being arranged on the at least one substrate and evenly spaced from each other along the at least one substrate; and wherein two opposite supporting members are formed on an inner surface of the light penetrable tube and extend along an axial direction of the light penetrable tube, the two opposite supporting members being spaced from each other, each of two lateral sides of the substrate being sandwiched between a corresponding supporting member and the inner surface of the light penetrable tube, the base of the heat sink being sandwiched between the two supporting members.

* * * * *